United States Patent [19]

Manchu

[11] Patent Number: 4,726,213

[45] Date of Patent: Feb. 23, 1988

[54] METHOD OF CONTROLLING A SHAPE OF A ROLLED SHEET MATERIAL

[75] Inventor: Tetsuo Manchu, Ishioka, Japan

[73] Assignee: Hitachi, Ltd., Tokyo, Japan

[21] Appl. No.: 803,642

[22] Filed: Dec. 2, 1985

[30] Foreign Application Priority Data

Dec. 3, 1984 [JP] Japan ..... 59-254018

[51] Int. Cl.[4] ..... B21B 37/00; B21B 31/16

[52] U.S. Cl. ..... 72/366; 72/8; 72/11; 72/16; 72/17; 72/243; 72/247; 364/472

[58] Field of Search ..... 72/8, 16, 17, 243, 247, 72/9–12, 365, 366; 364/472

[56] References Cited

U.S. PATENT DOCUMENTS

| | | | |
|---|---|---|---|
| 4,320,643 | 3/1982 | Yasuda et al. | 72/8 |
| 4,512,170 | 4/1985 | Hsu | 72/17 |
| 4,587,819 | 5/1986 | Hausen | 72/17 X |

OTHER PUBLICATIONS

"Analysis of Shape and Discussion of Problems of Scheduling Set-Up and Shape Control", P. D. Spooner et al, *Publ. Met. Soc.,* 1976, pp. 19–29.

*Primary Examiner*—Lowell A. Larson
*Assistant Examiner*—Steve Katz
*Attorney, Agent, or Firm*—Antonelli, Terry & Wands

[57] ABSTRACT

A shape controlling method for controlling the shape of a sheet rolled in a rolling mill, with the shape pattern of the sheet being approximated by a formula of an order of a large number, in accordance with the detected shape signals. Asymmetrical fundamental component (component of the first order) is extracted from the approximating formula. The control with respect to the fundamental component is allotted to the rolling reduction function, while the controls relative to the higher order asymmetrical components are conducted by other final control element than the rolling reduction function. The asymmetrical fundamental component causes winding of the sheet during rolling. By controlling the fundamental component separately from other components, it is possible to improve the shape of the rolled product while avoiding winding of the product under rolling operation.

4 Claims, 13 Drawing Figures

METHOD OF CONTROLLING A SHAPE OF A ROLLED SHEET MATERIAL

BACKGROUND OF THE INVENTION

1. Field of the Invention

The present invention relates to a shape controlling method for rolled sheet material.

The method of controlling the shape of a rolled sheet material necessitates the detection of the shape of the rolled sheet material by a shape detector and the recognition of the pattern of the detected shape. The shape of the rolled sheet can be expressed in terms of distribution of factors such as the steepness, defined more fully hereinbelow, elongation, stress or sheet thickness in the breadthwise direction of the sheet. Shape control is conducted by operating final control elements in such a manner that the detected shape coincides with a desired shape.

2. Description of the Prior Art

In order to attain the desired shape of a rolled sheet material, the actual shape is detected by a shape detector and a pattern of the detected shape is determined. Attempts have been made to express the shape pattern in terms of a series to the fourth power. Actually, however, the pattern does not always change smoothly or gently over the breadth of the rolled sheet material, and it has often been experienced that the pattern abruptly changes in regions near the with or breadthwide ends of the sheet material. It is, therefore, advisable to use a higher power series degree, e.g., sixth power, for expressing the shape pattern.

As stated before, the shape control is conducted by operating a plurality of final control elements in such a manner that detected shape pattern coincides with the desired shape pattern. This, however, encounters the following problems.

First, considerable time is required for the determination of the operating variables, because of interference between the final control elements. It follows that the shape control for attaining the desired shape is extremely difficult.

Secondly, it is to be pointed out that the control of the operating variable of one final control element with direct regard to the operating variables of other elements of the distribution of those which have to be done when the one final control element has achieved its control variable, are extremely difficult to carry out, so that further enhancement of the shape toward the desired shape is not achieveable.

Thus, there are practical limits in to the shape control effected by the conventional shape controlling methods, and therefore it is necessary to develop an improved shape controlling method.

In U.S. Pat. No. 4,320,643, a technique for asymmetric shape correction is proposed however, there is no indication as to the manner in which signals are delivered from the shape detector to the final control elements nor any suggestion as to a control for avoiding interference between different final control elements.

An article entitled "Analysis of Shape and Discussion of Problems of Scheduling Set-up and Shape Control", P. D. Spooner, G. F. Bryant, Publ. Met. Soc 1976, mentions shape parameters formed by signals derived from the shape detector, as well as the effect of differences between the roll-reduced position in on the shape of the rolled sheet material, but does not show at all which control element is controlled by each of the signals derived from the shape detector.

SUMMARY OF THE INVENTION

Accordingly, a primary object of the invention is to provide a shape control method for controlling the asymmetrical shape of a rolled product so as to attain a desired shape of the rolled product.

Another object of the invention is to provide a shape control method which is capable of ensuring a high precision of the shape control to avoid mutual interference between final control ends.

To these ends, according to one aspect of the invention, there is provided a shape controlling method which comprises the steps of approximating the shape pattern of a rolled sheet material by a high order function in accordance with signals from a shape detector; separating an asymmetric fundamental component (first order component) from the asymmetric component in the above-mentioned function; and effecting the shape control by allotting the control for the fundamental component to the rolling reduction control device, while allotting higher order components to other control elements.

According to another feature of the invention, the higher order components of the asymmetric shape pattern excepting the fundamental component are delivered to a plurality of final control elements including either one or both of a work roll bending device and an intermediate roll bending device.

DESCRIPTION OF THE PREFERRED EMBODIMENTS

Before describing preferred embodiments of the invention, an explanation will be given hereinunder as to the matters essential for the understanding of the invention.

Figure 1:
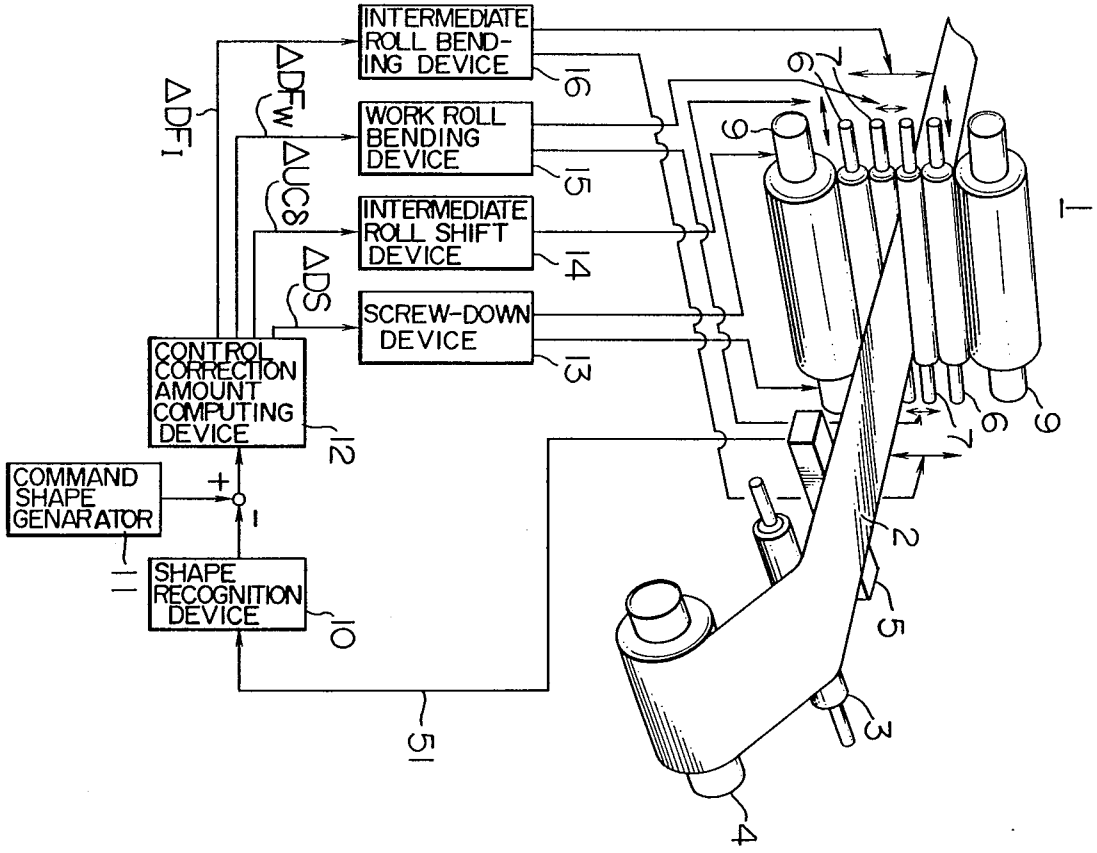
FIG. 1 shows the general arrangement of a shape control system in accordance with the invention.

Referring now to the drawings wherein like reference numerals are used throughout the various views to designate like parts and, more particularly, to FIG. 1, according to this figure, a shape control system according to the present invention is, applied to, for example, a six stage rolling mill generally designated by the reference numeral 1, with a steel sheet 2 rolled by the rolling mill 1 being taken up by a tension reel 4 via a deflector roll 3. The shape of the steel sheet is detected by a shape detector 5 and a shape recognition device 10 detects the shape parameters. A control correction amount computing device 12 computes control correction amounts from the deviation of the shape parameters actually detected by the shape recognition device 10 from the command parameters derived from a command shape generator 11. The computed control correction amounts are delivered to a work roll bending device 15, intermediate roll bending device 16, intermediate roll shift device 14 and the screw-down device 13.

The shape is detected by a shape of the sheet 2 detector 5. In this case, the stress distribution in the breadthwise direction is measured and is converted into the thickness deviation $\Delta h$ (deviation of thickness from the thickness at breadthwise center), so that the shape of the sheet 2 is recognized in terms of the thickness deviation $\Delta h$. As will be described later, the shape of the sheet 2 is a concept adopted for the purpose of evaluation of the flatness of the sheet 2, from the view point of elimination of, for example, unevenness such as center buckling and edge waving. Thus, the shape is expressed in terms of sheet breadthwise distribution of various factors such as steepness, elongation, stress and sheet thickness.

Figure 2:
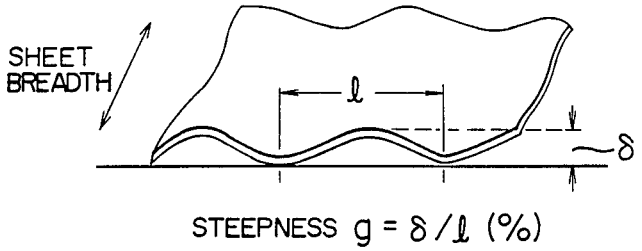
FIG. 2 is an illustration explaining the definition of the steepness of a plate shape.
Figure 3:
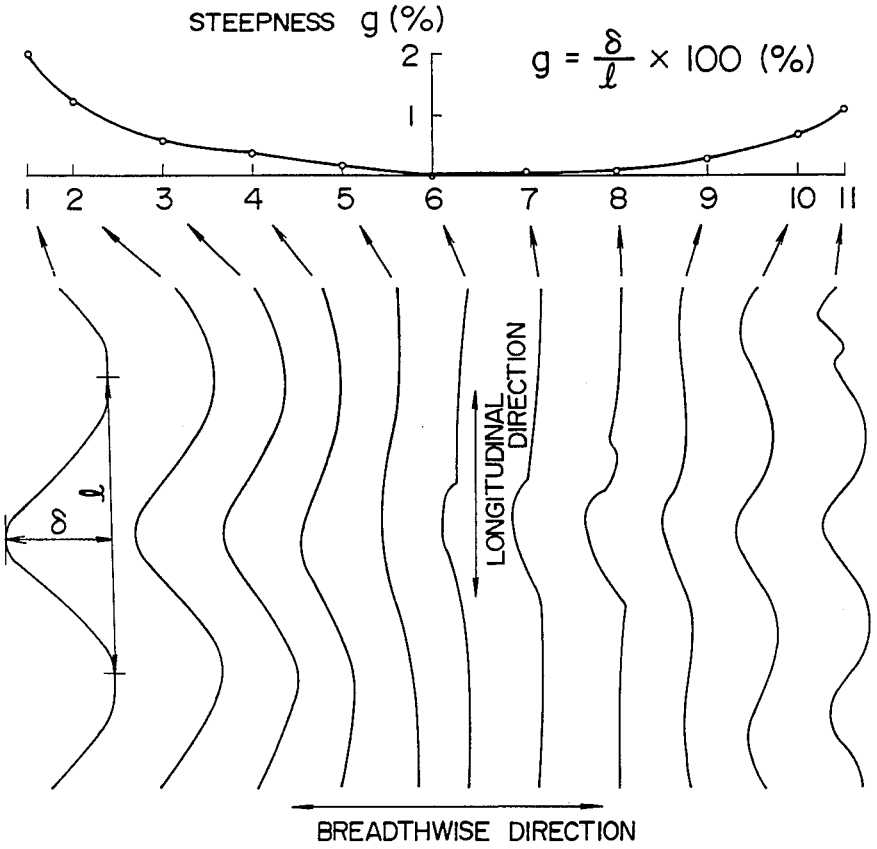
FIG. 3 shows examples of sheet shape as detected by a shape detector.

The definition of the concept of steepness will be explained with reference to FIG. 2. The steepness can be defined by the degree of waving of the sheet when the same is placed on a stool. More specifically, the steepness is defined as a ratio g between the amplitude and the period of the wave. FIG. 3 shows the steepness as determined from the stress distribution which, in turn, is obtained through a measurement by the shape detector 5 at eleven points spaced in the breadthwise direction of the sheet 2. In this case, edge waving is formed in the sheet 2.

Representing the steepness by y and the breadthwise distance by x, the shape attern can be approximated by the following formula (1) of the sixth degree.

$$y=\lambda_1 x+\lambda_2 x^2+\lambda_3 x^3+\lambda_4 x^4+\lambda_5 x^5+\lambda_6 x^6 \quad (1)$$

where, $\lambda_1$ to $\lambda_6$ are shape parameters.

This formula representing the shape is divided into two groups: namely, symmetrical component parameters ($\lambda_2$, $\lambda_4$, $\lambda_6$) and asymmetrical component parameters ($\lambda_1$, $\lambda_3$, $\lambda_5$). It is assumed also that the symmetrical and asymmetrical components are controllable for different shape patterns by three final control elements.

The relationship between the asymmetrical component parameters and the final control elements are linearized by DDC and expressed by the following formula.

$$\begin{bmatrix} \Delta\lambda_1 \\ \Delta\lambda_3 \\ \Delta\lambda_5 \end{bmatrix} = \begin{bmatrix} a_{11} & a_{12} & a_{13} \\ a_{21} & a_{22} & a_{23} \\ a_{31} & a_{32} & a_{33} \end{bmatrix} \begin{bmatrix} \Delta DM_1 \\ \Delta DM_2 \\ \Delta DM_3 \end{bmatrix} \quad (2)$$

In formula (2) above, symbols $a_{11}$, $a_{12}$ and $a_{13}$ represent control gains, i.e., the amounts $\Delta\lambda_1$, $\Delta\lambda_3$, $\Delta\lambda_5$ of the shape parameters $\lambda_1$, $\lambda_3$, $\lambda_5$ which are caused when the asymmetrical final control element $DM_1$ is operated solely by a small amount $\Delta DM_1$. Symbols $a_{21}$, $a_{22}$ and $a_{23}$ represent control gains, i.e., the amounts $\Delta\lambda_1$, $\Delta\lambda_3$, $\Delta\lambda_5$ of the shape parameters $\lambda_1$, $\lambda_3$, $\lambda_5$ which are caused when the asymmetrical final control element $DM_2$ is operated solely by a small amount $\Delta DM_2$. Similarly, symbols $a_{31}$, $a_{32}$ and $a_{33}$ represent control gains, i.e., the amounts $\Delta\lambda_1$, $\Delta\lambda_3$, $\Delta\lambda_5$ of the shape parameters $\lambda_1$, $\lambda_3$, $\lambda_5$ which are caused when the asymmetrical final control element $DM_3$ is operated solely by small amount $\Delta DM_3$. The values of these gains can be determined through experiments or computation by a numerical model representing the characteristics of the rolling mill.

It is thus possible to determine the control correction amounts $\Delta DM_1$, $\Delta DM_2$, $\Delta DM_3$ from the formula (2), provided that the deviations $\Delta\lambda_1$, $\Delta\lambda_3$, $\Delta\lambda_5$ of the actual shape from the command shape are given.

As will be understood from formula (2) which is shown by way of example, the number of control gains through which the final control elements are related to the shape parameters is increased to make the control difficult, if the irregular shape has to be determined and controlled. In addition, when one of the final control elements has to operate at its maximum ability, the control system in accordance with the formula (2) cannot operate any further because of the risk of mutual interference of other final control elements, even though other final control elements can still be effective. Any asymmetrical shape irregularity which can be approximated by a linear function causes not only an inferior sheet shape but also zig-zagging of the sheet, resulting in various problems in the operation of the rolling mill.

Under these circumstances, the present invention provides a method of control in which the control concerning at least the component approximated by a linear function among the asymmetric shape irregularities is conducted by a specific final control element, in such a manner that there is no interference of the final control element by other final control elements.

Figure 4:
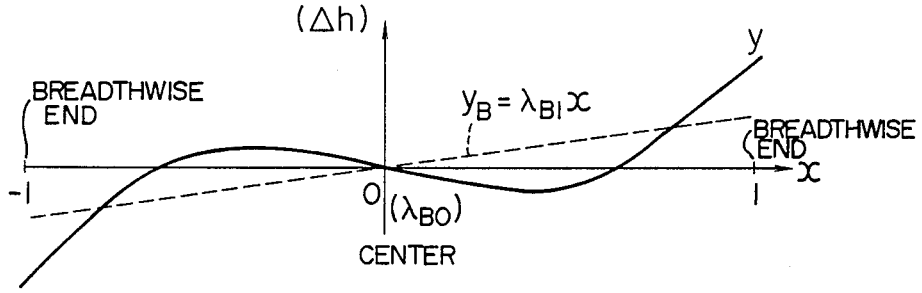
FIG. 4 is an illustration of a high degree curve approximating the sheet shape pattern, and the asymmetric fundamental component of the shape pattern.

FIG. 4 shows the concept of the relationship between the shape y and the asymmetric fundamental component (approximated by a linear function) $y_B$. The asymmetric fundamental component $D_L$ can be defined by the coefficient of the first order linear function which approximates the shape by minimum square method, and is given as follows:

$$y_B=\lambda_{B1}x(+\lambda_{B0}) \quad (3)$$

$$D_L=\lambda_{B1} \quad (4)$$

In these formula, x represents the coordinate value taken across the breadth of the sheet 2. The origin 0 of the x-axis coordinate coincides with the breadthwise center of the sheet 2 while both width or breadthwide ends are expressed by $x=+1$ and $x=-1$, respectively. The ordinate axis represents the steepness in terms of sheet thickness deviation.

Figure 5:
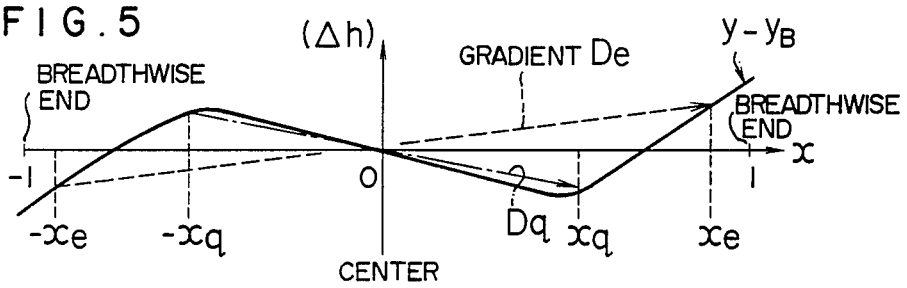
FIG. 5 is an illustration of a shape pattern and shape parameter after separation of the fundamental component.

FIG. 5 illustrates the concept of the relationships between the shape y of the rolled sheet and the parameters De, Dq which are the asymmetric higher order components obtained by subtracting the asymmetrical fundamental component $y_B$ from the shape y of the rolled sheet. As will be understood from FIG. 5, the parameter De is defined as a variable which represents the gradient from $-Xe$ to Xe, while the parameter Dq is defined as a variable which represents the gradient from $=Xq$ to Xq, and is given by the following formulae (5) and (6), respectively.

$$D_e = \frac{(y(x_e) - y_B(x_e)) - (y(-x_e) - y_B(-x_e))}{x_e - (-x_e)} \quad (5)$$

$$D_q = \frac{(y(x_q) - y_B(x_q) - (y(-x_q) - y_B(-x_q))}{x_q - (-x_q)} \quad (6)$$

Symbols ±Xe and ±Xq represent predetermined points.

The shape parameters $D_L$, De, Dq can be calculated by the following formula from the coefficients of the approximating function of the sixth degree.

$$D_L = \lambda_{B1} = \alpha_1\lambda_1 + \alpha_2\lambda_3 + \alpha_3\lambda_5\alpha_1 = 1,\ \alpha_2 = 3/5,\ \alpha_3 = 3/7 \quad (7)$$

This determines the value of$\lambda_{B1}$ which minimizes $$J = \int_{-1}^{1} (y - y_{B1})^2 dx$$

under the conditions of $y = \lambda_1 x + \lambda_3 x^3 + \lambda_5 x^5$ and $y_B = \lambda_{B1} x$.

On condition of $\alpha J/\alpha\lambda_{B1}$, the following condition is met and the values of $\alpha_1$, $\alpha_2$, $\alpha_3$ in formula (7) are determined.

$$(D_L) = \lambda_{B1} = \lambda_1 + 3/5\lambda_3 + 3/7\lambda_5$$

Thus, the following condition is established.

$$\begin{bmatrix} D_e \\ D_q \end{bmatrix} = \begin{bmatrix} \alpha_{11} & \alpha_{12} & \alpha_{13} \\ \alpha_{21} & \alpha_{22} & \alpha_{23} \end{bmatrix} \begin{bmatrix} \lambda_1 - \lambda_{B1} \\ \lambda_3 \\ \lambda_5 \end{bmatrix} \quad (8)$$

where, $\lambda_{11}$ to $\lambda_{23}$ are constants which are determined by the breadthwise coordinate values Xe, Xq.

The asymmetric components of the higher order shape components can be determined by the following formula (9), representing the gradient of thickness distribution between the sheet center and Xq by Cq gradient of thickness distribution between the sheet center and Xn by Cn and the gradient of thickness distribution between Xq and Xe by Ce.

$$\begin{bmatrix} C_e \\ C_q \\ C_n \end{bmatrix} = \begin{bmatrix} \beta_{11} & \beta_{12} & \beta_{13} \\ \beta_{21} & \beta_{22} & \beta_{23} \\ \beta_{31} & \beta_{32} & \beta_{33} \end{bmatrix} \begin{bmatrix} \lambda_2 \\ \lambda_4 \\ \lambda_6 \end{bmatrix} \quad (9)$$

where, $\beta_{11}$ to $\beta_{33}$ are constants which are determined by Xe, Xq and Xn.

Figure 7:
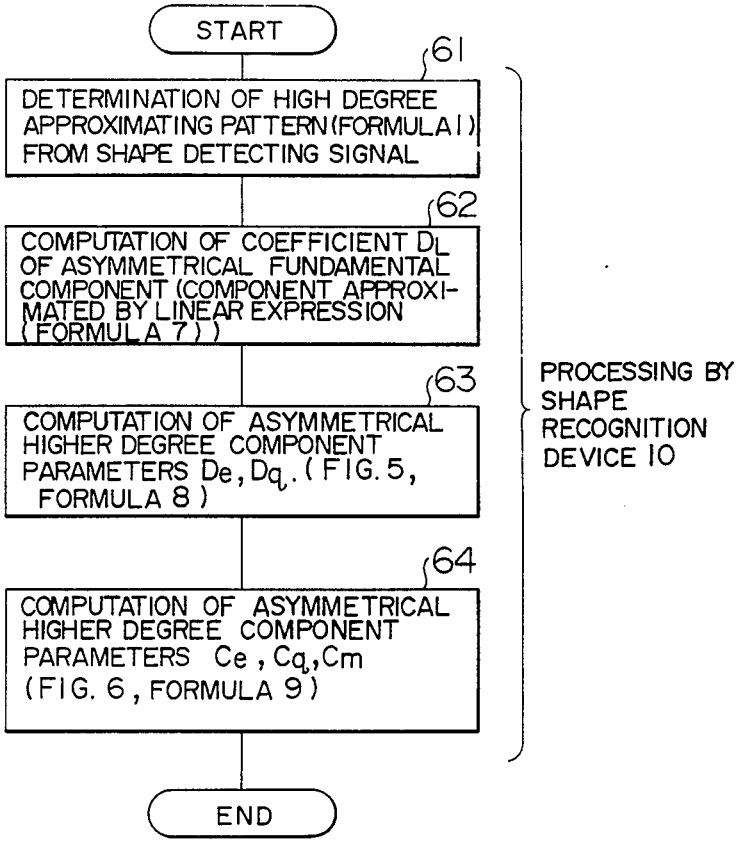
FIG. 7 is a flow chart of a process in which the shape is recognized by way of signals derived from the shape detector.

The above-described process performed by the shape recognition device 10 is shown in FIG. 7.

In step 61, the shape of the sheet 2 is approximated by function of the sixth degree, in accordance with the shape signal 51 derived from the shape detector 5. The shape is, for example, as shown by the formula (1).

In step 62, the asymmetric fundamental shape parameter, i.e., the fundamental component $y_B$ of the linear function, is defined by the coefficient of the first order as shown in FIG. 4.

Figure 6:
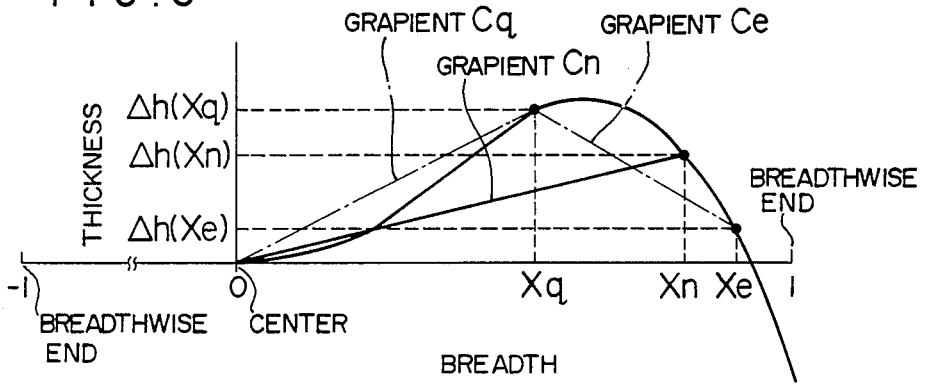
FIG. 6 is a diagram illustrating the shape parameters in the symmetric component.

In step 63, the symmetrical higher order component parameters De and Dq, other than the first order component of the asymmetrical component, are computed in the manner explained in connection with FIG. 5. In a step 64, the parameters Ce, Cq, Cn of symmetrical components of higher orders are defined in accordance with FIG. 6.

In the described embodiment, the determination of the shape in the order of high number is made by defining the shape as the gradient of the steel between two points spaced in the breadthwise direction. This, however, is not exclusive and the pattern recognition utilizing Fourier series can be adopted equally well.

As stated above, $D_L$, Dde, Dq and Ce, Cq, Cn are determined through the process shown in FIG. 7 by the operation of the shape recognition device 10. On the other hand, command parameter values $D_{LS}$, Des, Dqs and Ces, Cqs, Cns, corresponding to respective shape parameters mentioned above, are stored beforehand in a command shape generator 11. The deviations of respective parameters from the command parameter values are computed by a parameter deviation computing device 30.

Figure 8A:
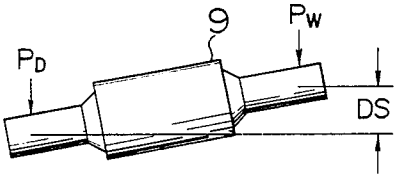
FIG. 8(A) is an illustration of rolling reduction control.

Then, the control correction amount computing device 12 computes the control correction amounts, in accordance with the parameter deviations computed by the parameter deviation computing device 30. In carrying out the shape control, the control with regard to the asymmetrical fundamental component $D_L$ is conducted by the rolling reduction DS serving as a final control element. It will be seen that the asymmetrical fundamental component (first order component) can approach zero because the functioning of rolling reduction usually has no stroke limit. The control with regard to $D_L$ can be allotted to another final control element such as a screw-down device 13 shown in FIG. 1. FIG. 8(A) illustrates the rolling reduction DS. A desired DS value is obtained by the power of the screw-down device 13 and the level control performed by a backuproll 9 (omitted from FIG. 9). The controls of De and Dq are conducted, respectively, such that the work roll bending pressure differential DFw and the intermediate roll bending pressure differential $DF_I$ coincide with respective desired values.

Figure 8B:
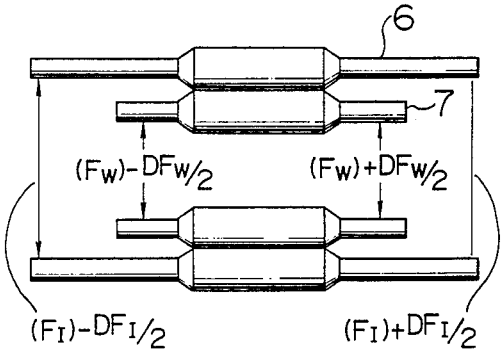
FIG. 8(B) illustrates examples of bender pressure differential control for a work roll bender and intermediate roll bender.

An explanation will be made in regard to DFw and $DF_I$ with reference to FIG. 8(B). As will be understood from this Figure, the bending differences are, for example, (Fw)±DFw/2, $(F_I) \pm DF_I/2$.

The relationships between the shape parameters $D_L$, De, Dq and respective final control elements DS, DFw and $DF_1$ are expressed by the following formula.

$$\begin{bmatrix} \Delta D_L \\ \Delta D_e \\ \Delta D_q \end{bmatrix} = \begin{bmatrix} b_{11} & 0 & 0 \\ 0 & b_{22} & b_{23} \\ 0 & b_{32} & b_{33} \end{bmatrix} \begin{bmatrix} \Delta DS \\ \Delta DF_W \\ \Delta DF_I \end{bmatrix} \quad (10)$$

In this formula, $b_{11}$ to $b_{33}$ represent the control gains explained before.

When the deviations $\Delta D_L$, ΔDe and ΔDq between the command shape and the arcuate shape are recognized, the control correction amount computing device computes the correction amounts ΔDS, ΔDFw and $\Delta DF_I$ and delivers the same to respective final control elements.

$$\begin{bmatrix} \Delta DS \\ \Delta DF_W \\ \Delta DF_I \end{bmatrix} = \begin{bmatrix} b_{11} & 0 & 0 \\ 0 & b_{22} & b_{23} \\ 0 & b_{32} & b_{33} \end{bmatrix} \begin{bmatrix} \Delta D_L \\ \Delta D_e \\ \Delta D_q \end{bmatrix} \quad (11)$$

In the described embodiment, the work roll bending device and the intermediate roll bending device are utilized as the final control elements besides the functions of rolling reduction. This arrangement, however, is only illustrative and an intermediate roll shift, for example, can be used as the control element for correction of a higher order.

Figure 9A:
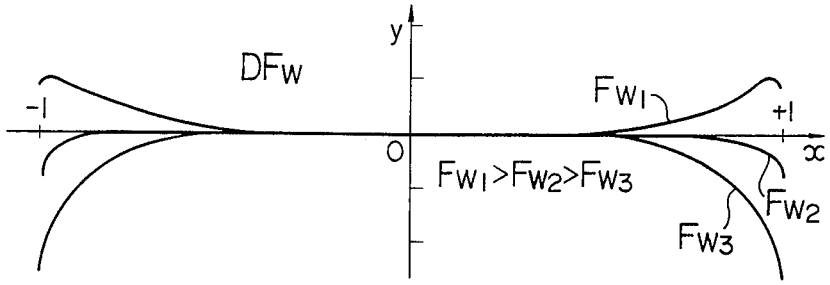
FIGS. 9(A) to 9(D) show the result of simulation of the change in the shape in accordance with the operation of the final control elements.
Figure 9B:
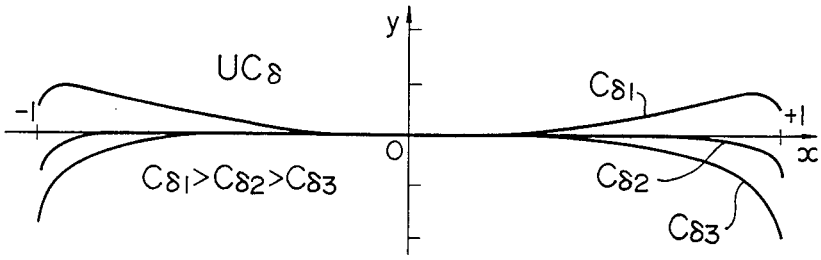
Figure 9C:
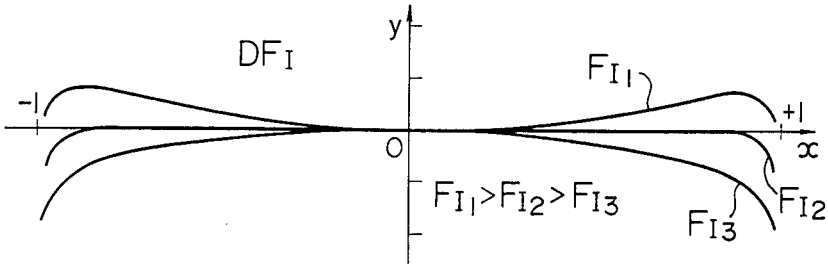
Figure 9D:
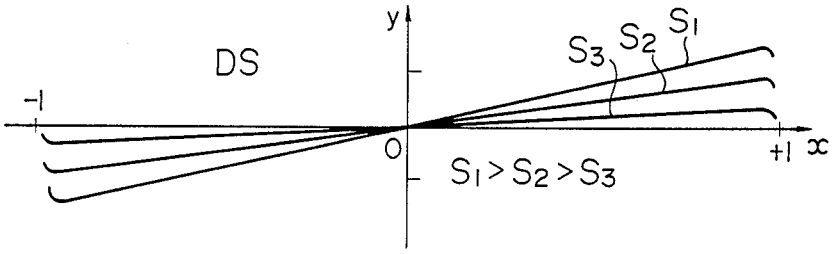

FIGS. 9(A) to 9(D) show the results of a simulation test conducted for examining the influences of respective final control element on the sheet shape. FIG. 9(A) shows how the sheet shape is influenced by the operation of the work roll bender DFw when the work roll bender pressure differential $F_{W1}$, $F_{W2}$ and $F_{W3}$ are applied. The work roll bender pressure differentials are selected to meet the condition of $F_{W1}>F_{W2}>F_{W3}$. Similarly, FIGS. 9(B), 9(C) and 9(D) show how the sheet shape is influenced by changes in the intermediate roll shift amount (UC), intermediate roll bender pressure differential $DF_I$ and the rolling reduction DS. It will be seen that different final control elements cause different extents of influence on the shape of the sheet on different areas. The present invention is characterized in that the shape control is conducted in full consideration of these features of the final control elements.

According to the controlling method of the invention, the correction of fundamental component asymmetrical shape irregularity and the correction of higher order components of the same are conducted without causing mutual interference. The correction of the asymmetric fundamental component by the rolling reduction function can be continued even after other final control element so that the roll bender has exerted its correcting ability. It is, therefore, possible to avoid undesirable zig-zagging of the steel sheet and to reduce the number of the control gains through which the control variables are related to the shape parameters can also be reduced, thus facilitating the formation of the numerical model. In addition, the optimization of the control system is facilitated by adopting numerical models which express the relationship between the control variables and the shape parameters, so that the shape control can be performed with high precision.

As has been described, according to the invention, the shape control by the levelling difference of the screw-down device and the shape control by other final control elements can be conducted without causing interference therebetween, so that it becomes possible to properly correct the shape of the rolled steel sheet while avoiding the zig-zagging of the same. In addition, a simple, easily adjustable and effective control can be conducted by virtue of the reduction in the number of control gains through which the final control elements are related to the shape parameters.

The devices 10 to 16 shown in FIG. 1 can easily be realized by an ordinary processing means such as a microcomputer or a controlling computer, without imparing the essence of the invention. Although FIG. 1 illustrates only the outlet side of a irreversible rolling stand of the rolling mill 1, the shape detector 5 may be disposed on either the inlet or outlet side of a reversible rolling stand or on both sides of each rolling stand of a continuous rolling mill having a plurality of stands.

The correction for the symmetrical components of the shape irregularity has not been described fully but mentioned simply in connection with formula (9). However, it will be clear to those skilled in the art that the control in connection with the symmetric component may be done in accordance with suitable formulae corresponding to the formulae (10) and (11) explained in connection with the control for the asymmetrical components.

The breadthwise positions of the points ±Xe and ±Xq for determining the parameters of asymmetric higher order components are usually selected as follows. Namely, the position of the point ±Xe is selected to be X=±0.9, while the position of the point ±Xq is determined to be in the vicinity of the inflection point of the shape pattern curve. The reason why the position of the point ±Xe is selected to be ±0.9 is that the shape control at the breadthwise ends of the sheet is generally difficult and that the shape of the edge portions in some cases cannot be expressed by a pattern curve. The position of the point ±Xq may be determined in consideration of, for example, the mean steepness.

I claim:

1. A method of controlling a shape of a sheet having a predetermined width in a breadthwise direction by a rolling mill comprising rolls and a plurality of control devices including a rolling reduction control device for controlling a levelling of said rolls, by operating at least one of said control devices in accordance with an actual pattern shape of the sheet determined by parameters which can be measured and which represent a flatness of the sheet, the method comprising the steps of:

measuring said parameters in a breadthwise direction to obtain an actual pattern shape of the sheet;

approximating said pattern shape to a linear function of said parameters and a variable, representing the shape of the sheet in a breadthwise direction by a power series function of said pattern and said variable, said power series function having a plurality of odd numbered power terms; and producing a signal for controlling an adjustment of a leveling of said rolling mill from an approximated linear expression of said linear function of said shape pattern and applying said signal to said roll reduction control device for adjusting the leveling of said rolling mill, thereby controlling said adjustment of the leveling without interference of another type of adjustment employing another signal produced from said linear function independently of said signal.

2. A method according to claim 1, wherein said linear function is determined such that the linear function has coefficients which are obtained by least squares method from coefficients related to a plurality of linear functions each respectively approximating the odd numbered power terms of the power series expression.

3. A method of controlling the shape of a sheet produced by a rolling mill comprising at least a pair of working rolls, intermediate rolls in a plurality of control devices for controlling a shape of the sheet, including a roll reduction control device, a roll bending control device and a roll shifting control device, by operating said control devices in accordance with an actual pattern shape of the sheet predetermined by a plurality of parameters which can be measured and represent a flatness of the sheet, the method comprising the steps of:

measuring said parameters in a breadthwise direction of the sheet to obtain an actual shape pattern of the sheet, approximating said pattern shape to a linear function of said parameters and a variable, representative of the shape of the sheet in the breadthwise direction, by a power series function of said parameters and the variable, said power series having a plurality of odd numbered power terms and a plurality of even numbered power terms; producing a signal for controlling adjustment of the leveling of said rolling mill from said linear function of said pattern, and applying said signal to said roll reduction control device for adjusting the leveling of said rolling mill, producing a signal for controlling an adjustment of at least one of the bending and shifting by said rolls from the power terms other than the first power term of said power series function of said pattern shape, and applying said signal at least one of said roll bending and shifting control devices for adjusting at least one of said bending and shifting by said rolls of said rolling mill.

4. A method according to claim 3, wherein said parameters of said series includes a first gradient representing a line interconnecting predetermined points near the breadthwise ends of said roll sheet, and a second gradient representing a line interconnecting predetermined points nearer to a breadthwise center of said rolled sheet than said first predetermined points.

* * * * *